US006654968B2

(12) United States Patent
Braun et al.

(10) Patent No.: US 6,654,968 B2
(45) Date of Patent: Dec. 2, 2003

(54) APPARATUS AND METHOD FOR ADJUSTING THE LENGTH OF A GARMENT LIMB

(75) Inventors: David C. Braun, Milwaukee, WI (US); Sean M. Coyle, Mukwonago, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 10/040,812

(22) Filed: Jan. 7, 2002

(65) Prior Publication Data

US 2003/0126667 A1 Jul. 10, 2003

(51) Int. Cl.[7] ..... A41D 27/00
(52) U.S. Cl. ..... 2/269; 2/69
(58) Field of Search ..... 2/72, 124, 126, 2/227, 80, 269, 69, 93, 108, 125; 190/18 A, 39, 103, 115, 111

(56) References Cited

U.S. PATENT DOCUMENTS

| | | | | | |
|---|---|---|---|---|---|
| 560,683 | A | * | 5/1896 | Bruckner | 2/227 |
| 2,104,826 | A | * | 1/1938 | Stramiello | 2/126 |
| 2,507,463 | A | * | 5/1950 | Smith | 2/76 |
| 2,716,754 | A | * | 9/1955 | Hirsch | 2/227 |
| 3,443,671 | A | * | 5/1969 | Dyke | 190/103 |
| 4,068,316 | A | * | 1/1978 | Haywood | 2/126 |
| 4,215,435 | A | * | 8/1980 | Miele | 2/227 |
| 4,573,218 | A | * | 3/1986 | Saggs | 2/93 |
| 4,697,288 | A | * | 10/1987 | Palumbo | 2/269 |
| 4,773,515 | A | * | 9/1988 | Kotkins, Jr. | 190/103 |
| 5,050,244 | A | * | 9/1991 | Kleinman | 2/227 |
| 5,060,795 | A | * | 10/1991 | Bomes et al. | 206/279 |
| 5,182,812 | A | * | 2/1993 | Goldsby | 2/79 |
| 5,208,920 | A | * | 5/1993 | Schaefer et al. | 2/269 |
| 5,307,908 | A | * | 5/1994 | Shyr et al. | 190/18 A |
| 5,404,592 | A | * | 4/1995 | Jackson | 2/125 |
| 5,539,932 | A | * | 7/1996 | Howard | 2/269 |
| 5,628,064 | A | * | 5/1997 | Chung | 2/70 |
| 5,708,977 | A | * | 1/1998 | Morkunas | 2/80 |
| 6,058,508 | A | * | 5/2000 | Brown Honeysuckle | 2/69 |
| 6,196,366 | B1 | * | 3/2001 | Lin | 190/18 A |
| 6,298,485 | B1 | * | 10/2001 | Heller | 2/70 |
| 6,349,413 | B1 | * | 2/2002 | Rose et al. | 2/126 |
| 6,360,372 | B2 | * | 3/2002 | Oster | 2/126 |
| 6,473,904 | B2 | * | 11/2002 | Long | 2/2.15 |

OTHER PUBLICATIONS

Harley–Davidson Motor Clothes, Victory Jacket, Genuine Motorclothes and Collectibles Fall 1995, 7/95, p. 12, U.S.A.

Harley–Davidson Motor Clothes, Panhead Jacket, Genuine Motorclothes and Collectibles 1995, 6/94, p. 8, U.S.A.

* cited by examiner

*Primary Examiner*—John J. Calvert
*Assistant Examiner*—Alissa L Hoey
(74) *Attorney, Agent, or Firm*—Michael Best & Friedrich LLP

(57) ABSTRACT

An article of clothing includes a body portion and a limb portion (e.g. a sleeve or pant leg) coupled to the body portion. The limb portion includes an expandable portion and a zipper assembly configured such that the zipper may be adjusted to extend and retract the limb portion between a standard length, and an elongated length. Closing the zipper assembly adjusts the limb portion to the standard length, opening the zipper adjusts the limb portion to the elongated length. The elongated length is particularly well suited for use during activities where the wearer's arms or legs may be outstretched, such as motorcycling.

33 Claims, 6 Drawing Sheets

APPARATUS AND METHOD FOR ADJUSTING THE LENGTH OF A GARMENT LIMB

FIELD OF THE INVENTION

The invention relates to garments, and more particularly to garments that are adjustable in size.

BACKGROUND OF THE INVENTION

Through the years, motorcycles have taken on a variety of shapes, sizes, and configurations. While motorcycles began simply as an improvement in personal transportation, they have evolved into the sportbikes, touring bikes, cruisers, and off-road bikes seen today. Driven both by function and form, the riding posture of the motorcycle operator varies greatly throughout the classes of motorcycles. For example, a sportbike is typically configured to place a rider in a crouched position. The seat is usually relatively high and the footpegs are often positioned directly below or slightly behind the seat. Sportbike handlebars are typically low and forward, forcing the rider to lean forward and fully extend his arms in order to reach the handlebars. Touring bikes on the other hand typically have lower seat heights and handlebars that are higher and closer to the motorcycle seat. This configuration provides a comfortable upright posture with the arms only partially outstretched. Cruisers typically have extremely low seats and footpegs that are positioned well forward. The handlebars on cruisers range from "pulled-back" bars where the rider's arms are relatively close to his chest, to "ape-hangers" where the rider's arms may be forwardly and upwardly extended to a position well above his head.

A result of the variety of riding positions encountered in the motorcycle world is that traditionally configured jackets and pants do not work well because the sleeves and pant legs are generally too short when the wearer is in a riding position. The prior solution to this problem has been to make motorcycle jackets and pants with extra long sleeves and legs. This solution has limited effectiveness however because the required additional lengths vary between the different riding positions encountered, and the extra long sleeves and pant legs are often cumbersome and annoying to the wearer when not riding.

SUMMARY OF THE INVENTION

The present invention provides a garment that has variable length limb portions (e.g. sleeves or pant legs) to accommodate a variety of riding positions and rider statures. For example a rider may extend the sleeves of a jacket for riding a sportbike or a cruiser, and then retract the sleeves during touring riding or when not riding at all. A pair of pants may be similarly adjusted. The result is universal garments that function equally well in a variety of riding and non-riding situations.

More specifically, one embodiment of the present invention provides an article of clothing having a body portion that is adapted to at least partially surround a human torso and at least one sleeve joined to the body portion. The sleeve joins the body portion along a sleeve edge and includes a cuff area with a cuff opening that is surrounded by a cuff edge. A first sleeve length extends between the cuff edge and the sleeve edge. An expandable portion is also formed in the sleeve such that the expandable portion may be adjusted to extend the sleeve to a second sleeve length, the second sleeve length being longer than the first sleeve length.

Preferably, the expandable portion of the article of clothing is located between the cuff edge and the sleeve edge. The expandable portion may also include an upper edge that extends circumferentially around the sleeve and a lower edge that also extends circumferentially around the sleeve. Preferably, a fabric portion extends between the upper and lower edges. To facilitate adjustment of the sleeve length, the upper and lower edges may be joined, thereby adjusting the sleeve to the first sleeve length. Alternatively, the upper and lower edges may be separated, thereby adjusting the sleeve to the second sleeve length. Preferably, the upper edge includes an upper row of zipper teeth, and the lower edge includes a lower row of zipper teeth such that the rows of zipper teeth are joined and separated to adjust the sleeve between the first and second sleeve lengths respectively. The article of clothing is also preferably configured such that the expandable portion is hidden from view when the sleeve is adjusted to the first sleeve length.

Another embodiment of the invention includes adjustable length pant legs of a pair of pants. The specific construction and operation of the invention is substantially the same for both the jacket sleeve and the pant leg, the pant leg similarly including upper and lower portions joined by an expandable portion.

Other features and advantages of the invention will become apparent to those skilled in the art upon review of the following detailed description, claims, and drawings.

Figure 1:
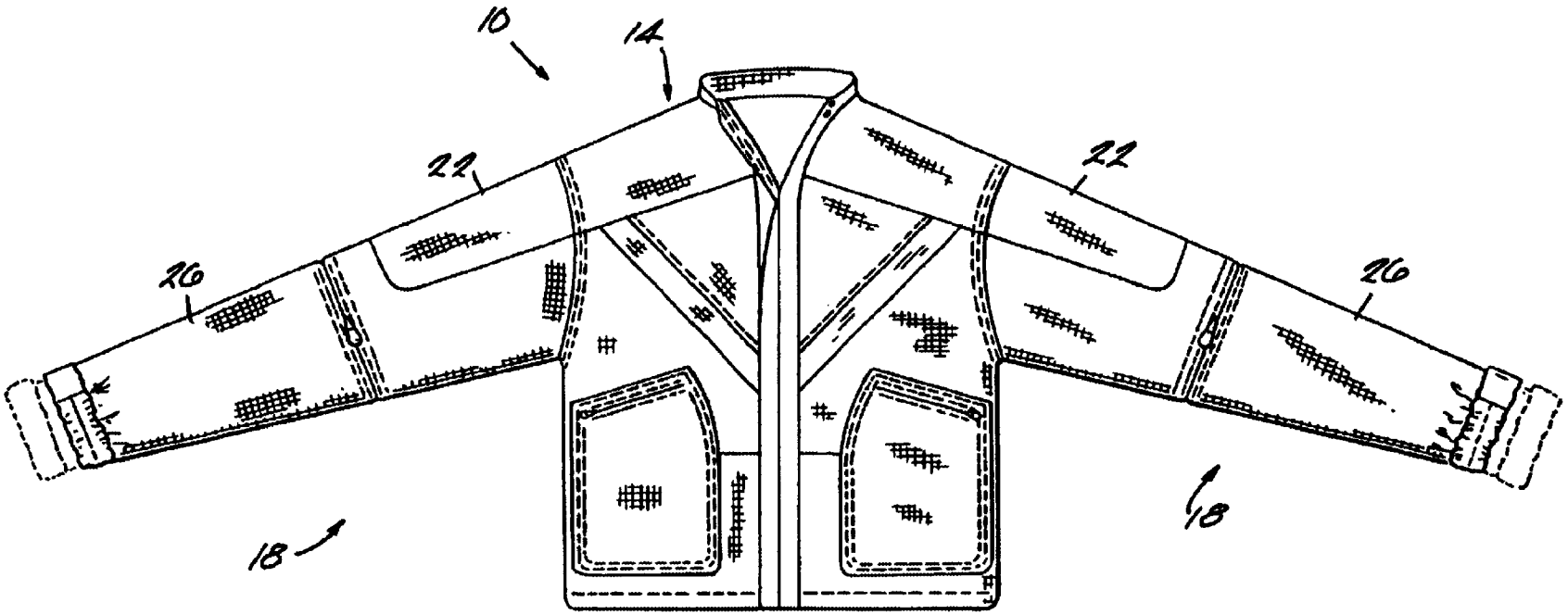
FIG. 1 is a front view of a jacket including an expandable sleeve embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates an article of clothing embodying the present invention in the form of a motorcycle jacket 10. The jacket 10 includes a body portion 14 of known construction adapted to surround the torso area of a wearer. Coupled to each side of the body portion 14 is a sleeve 18. The sleeve 18 includes an upper sleeve portion 22 and a lower sleeve portion 26. The upper portion 22 and lower portion 26 are movable with respect to each other such that the sleeve 18 is adjustable between a first, retracted position (illustrated in solid in FIG. 1), and a second, extended position (illustrated in phantom in FIG. 1) as described below.

While not limited as to the specific construction, the jacket 10 is preferably configured to be abrasion resistant and may also be waterproof. The jacket 10 may be fabricated from materials such as leather, CORDURA™, nylon, and the like, and may also include additional padded and abrasion resistant sections often referred to as armor. It should be appreciated that the apparatus and method described herein are applicable to a variety of clothing types. As such, the following description outlining the invention as embodied in a jacket sleeve should not be regarded as limiting.

Figure 2:
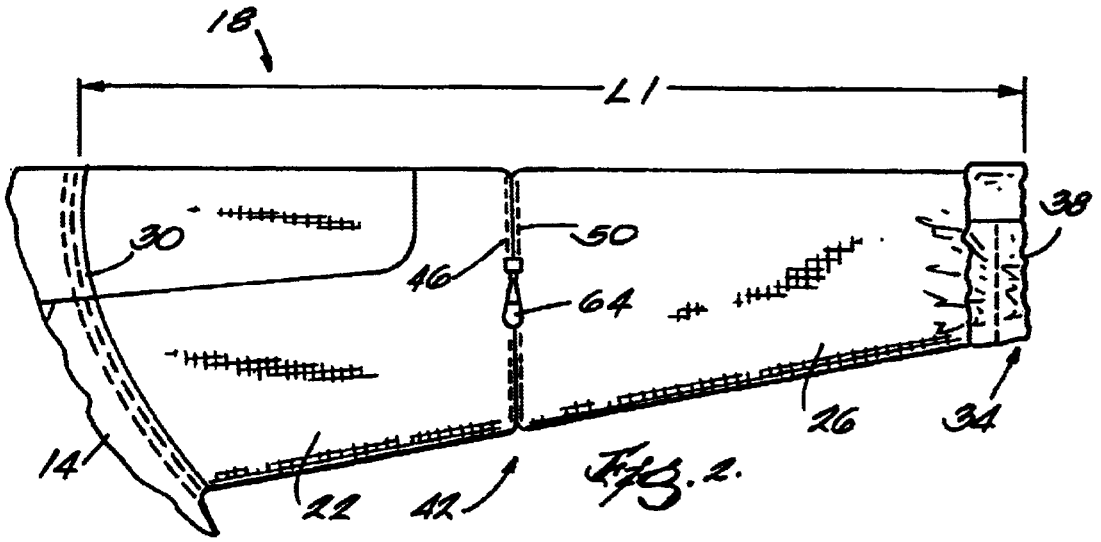
FIG. 2 is a front view of the expandable sleeve in a first, shortened configuration.

FIG. 2 illustrates the sleeve 18 in the first, retracted position. The sleeve 18 joins the body portion 14 along a sleeve edge 30. In the present embodiment, the sleeve edge 30 is defined by a double-stitched seam extending circumferentially around the upper portion 22. The seam effectively secures the upper portion 22 to the body portion 14. Other types of constructions are possible however and the sleeve edge 30 may be defined in a different manner or with alternative structure than illustrated and described above. The distal end of the sleeve 18 includes a cuff portion 34 and a cuff edge 38. The cuff portion 34 preferably includes a resilient material such as elastic and/or straps that may include hook and loop style closures to provide a snug fit around a wearer's wrist. Intermediate the sleeve edge 30 and the cuff edge 38, the upper sleeve portion 22 is joined to the lower sleeve portion 26 by an expandable portion 42. In the retracted position (illustrated in FIG. 2), an upper edge 46 of the expandable portion 42 is positioned adjacent to a lower edge 50 of the expandable portion 42 as further described below. Both the upper edge 46 and lower edge 50 extend circumferentially around the entire sleeve 18. When configured as illustrated in FIG. 2, the sleeve 18 includes a first length Li that extends from the sleeve edge 30 to the cuff edge 38.

Figure 3:
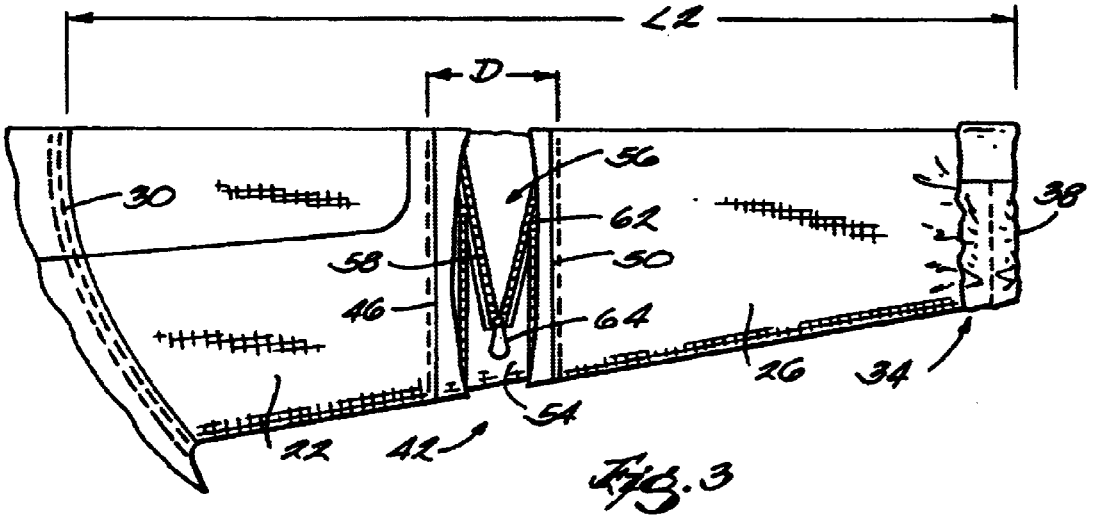
FIG. 3 is a front view of the expandable sleeve in a second, extended configuration.
Figure 4:
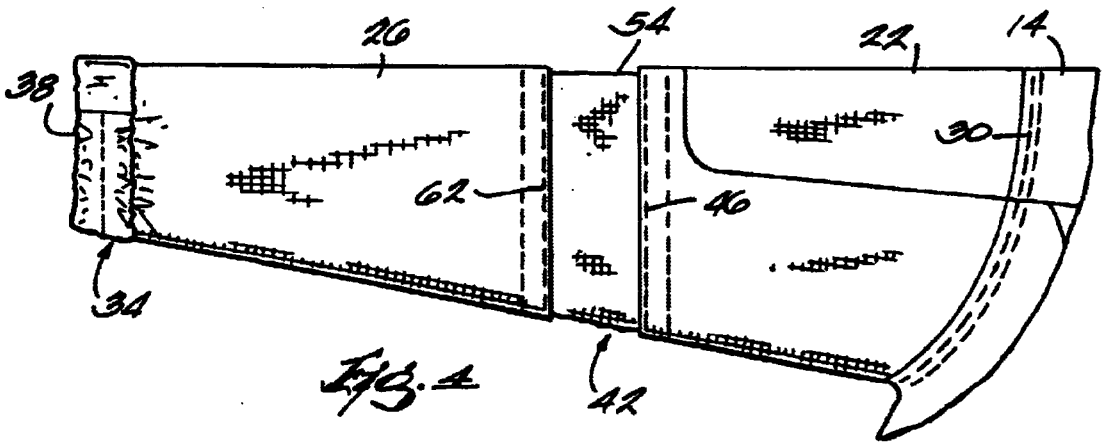
FIG. 4 is a rear view of the expandable sleeve in the second, extended configuration.

FIGS. 3 and 4 illustrate the sleeve 18 in the second, extended position. When in the extended position, the upper edge 46 is separated from the lower edge 50 by a distance D. As a result, a second sleeve length L2 extends from the sleeve edge 30 to the cuff edge 38 and is approximately equal to the sum of the first sleeve length L1 and the distance D. A fabric portion 54 of the expandable portion 42 extends between the upper edge 46 and the lower edge 50. Referring back to FIG. 2 it can be seen that the fabric portion 54 is hidden from view when the sleeve 18 is adjusted to the first position. To facilitate adjustment of the sleeve 18 between the first and second positions, the sleeve 18 also includes a zipper assembly 56 including an upper row of zipper teeth 58, a lower row of zipper teeth 62, and a zipper pull 64.

Figure 5:
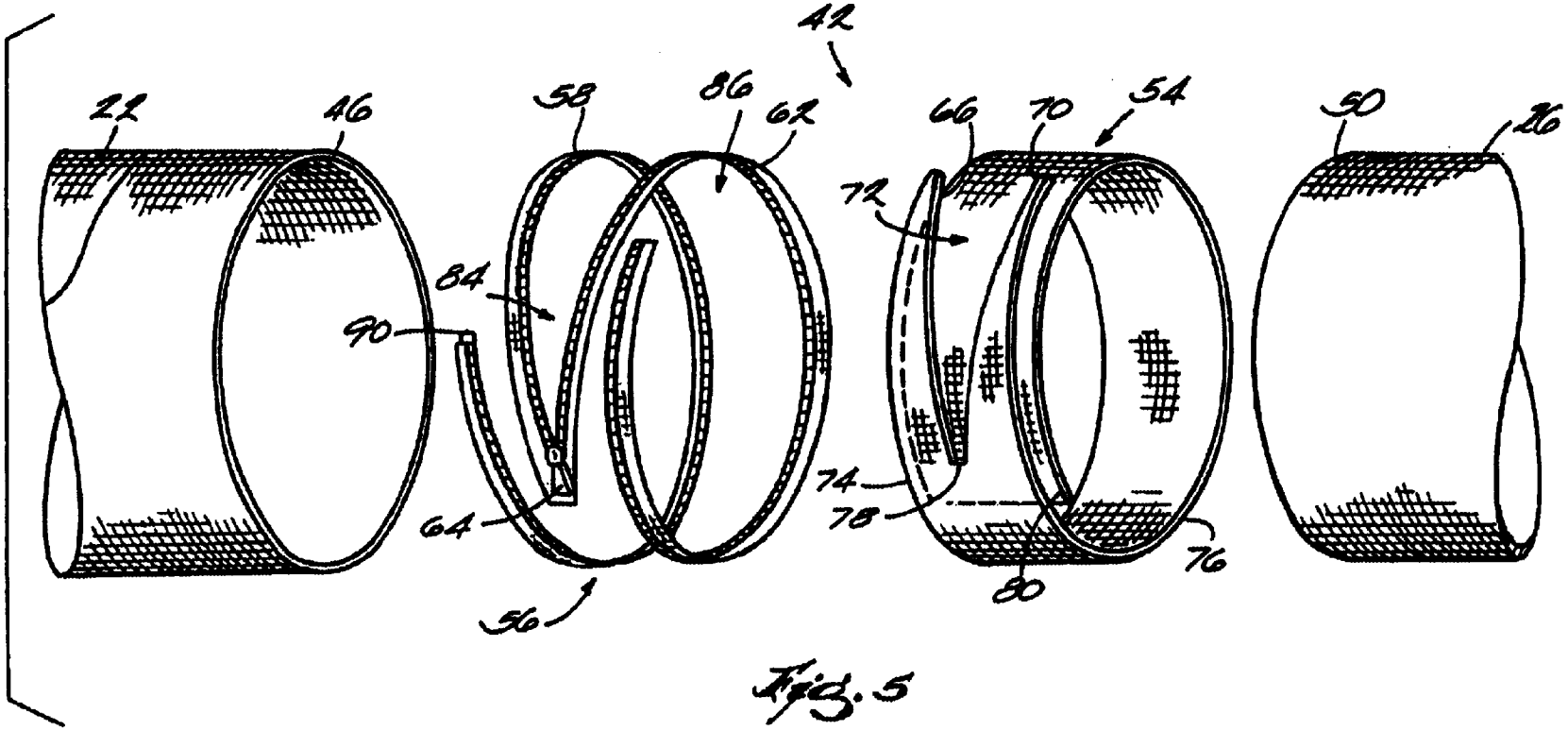
FIG. 5 is an exploded view of the expandable portion of the sleeve.
Figure 8:
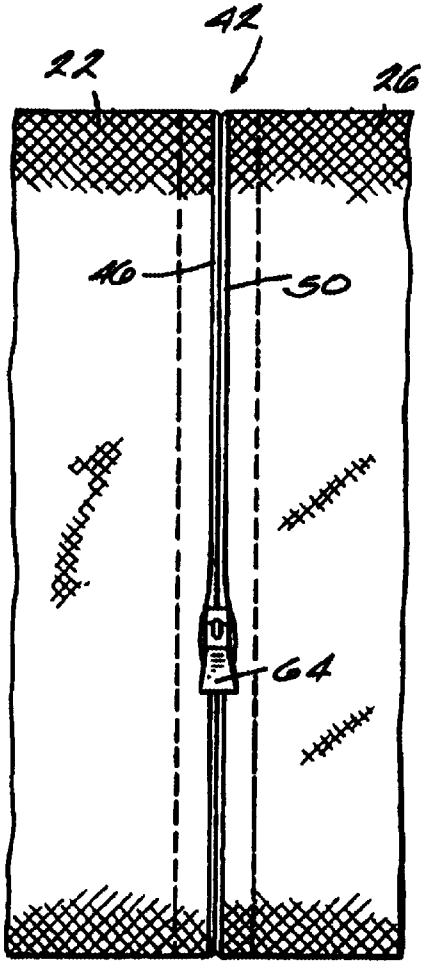
FIG. 8 is an enlarged view of the expandable portion in the first, shortened configuration.

Referring specifically to FIG. 5, the fabric portion 54 includes a first angled edge 66 and a second angled edge 70 that define a V-shaped cutout 72 in the fabric portion 54. The fabric portion 54 also includes a first edge 74 and a second edge 76, the edges 74, 76 being substantially parallel to each other. The first and second angled edges 66, 70 extend away from the first and second edges 74, 76 respectively and converge to a point 78 approximately midway between the first and second edges 74, 76. The V-shaped cutout 72 of the fabric portion 54 is then positioned in an overlapping manner with respect to an opposite end 80 of the fabric portion 54 forming a continuous loop of fabric. A transverse stitch 82 (See FIG. 6) secures the fabric portion 54 in the looped configuration. A portion of the upper row of zipper teeth 58 is stitched to the first angled edge 66, and a portion of the lower row of zipper teeth 62 is stitched to the second angled edge 70, thereby forming a divergent portion 84 of the zipper assembly 56. The remainder of the upper row 58 is stitched to both the first edge 74 and the upper edge 46, and the remainder of the lower row 62 is stitched to the second edge 76 and the lower edge 50, thereby forming a parallel section 86 of the zipper assembly 56. Securing the upper and lower rows 58, 62 in this manner also secures the first and upper edges 74, 46 to each other and the second and lower edges 76, 50 to each other, thereby securing the lower sleeve portion 26 to the fabric portion 54, and the fabric portion 54 to the upper sleeve portion 22. The zipper pull 64 selectively joins and separates the individual teeth of the upper and lower rows 58, 62 as the zipper pull 64 is moved circumferentially around the sleeve 18.

Figure 7:
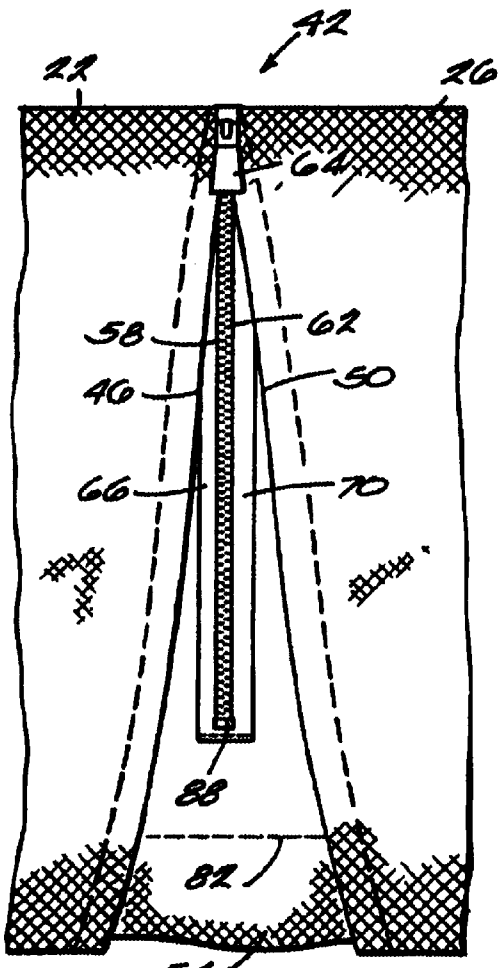
FIG. 7 is an enlarged view of the expandable portion in an intermediate configuration.
Figure 6:
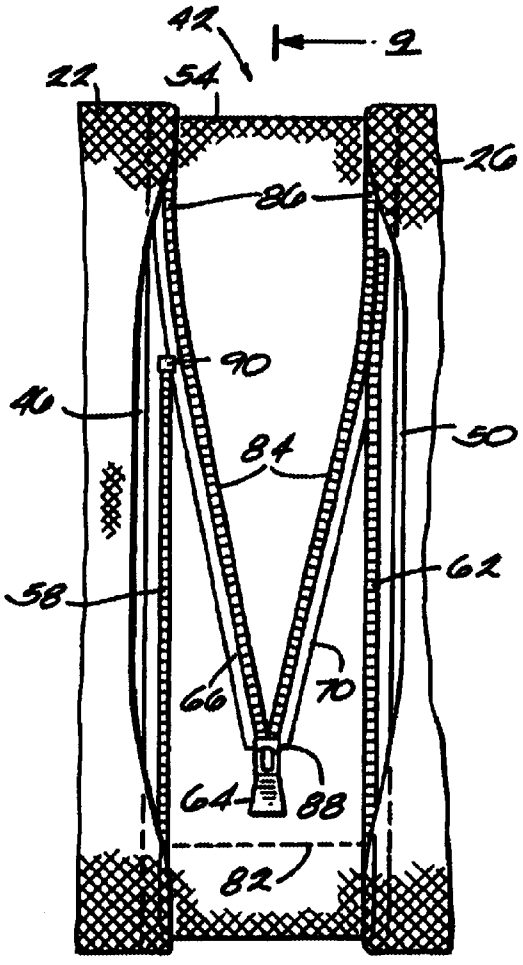
FIG. 6 is an enlarged view of the expandable portion in the second, extended configuration.
Figure 9:
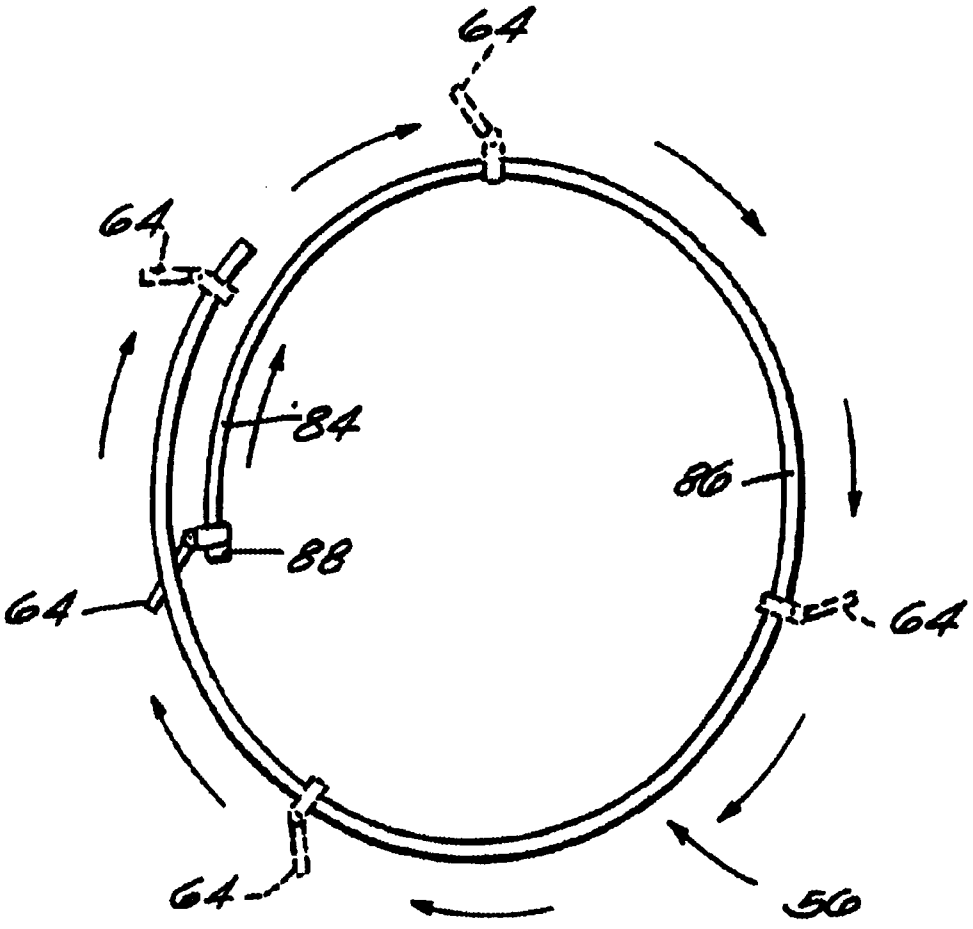
FIG. 9 is a section view taken along line 9—9 of FIG. 6.

Referencing FIGS. 6–9, the zipper pull 64 is positioned against a first zipper stop 88 when the sleeve 18 is in the extended position (FIG. 6). Also, the upper and lower rows of zipper teeth 58, 62 as well as the upper and lower edges 46, 50, are separated from each other. A small number of zipper teeth of the upper row 58 remain joined to corresponding teeth of the lower row 62 near the first zipper stop 88. To adjust the sleeve 18 to the retracted position, a wearer grasps the zipper pull 64 and moves it circumferentially around the sleeve 18 in a first direction (See arrows in FIG. 9). Initially, the first and second angled edges 66, 70 are drawn together, until an intermediate stage of adjustment is reached as shown in FIG. 7. At this stage, the zipper pull 64 has been moved to a position such that the first and second angled edges 66, 70 have been completely joined to each other and the upper and lower edges 46, 50 are partially adjacent to each other. Continuing to move the zipper pull 64 in the first direction joins additional zipper teeth of the upper and lower rows 58, 62, thereby drawing the upper edge 46 toward the lower edge 50. As the zipper pull 64 is moved around the sleeve 18, the fabric portion 54 is gathered together and becomes hidden by the upper sleeve portion 22 and the lower sleeve portion 26 (See FIG. 8). When the zipper pull 64 abuts a second zipper stop 90, the adjustment to the retracted position is complete. In this configuration, the upper and lower rows of zipper teeth 58, 62 are completely joined and the upper and lower edges 46, 50 are adjacent to each other about the entire circumference of the sleeve 18. Adjusting the sleeve 18 back to the extended position comprises moving the zipper pull 64 in a second direction, opposite the first direction, from the second zipper stop 90, circumferentially around the sleeve 18, and back to the first zipper stop 88, thereby separating the upper and lower rows of zipper teeth 58, 62 and allowing the upper and lower edges 46, 50 to be once again spaced from each other.

Figure 10:
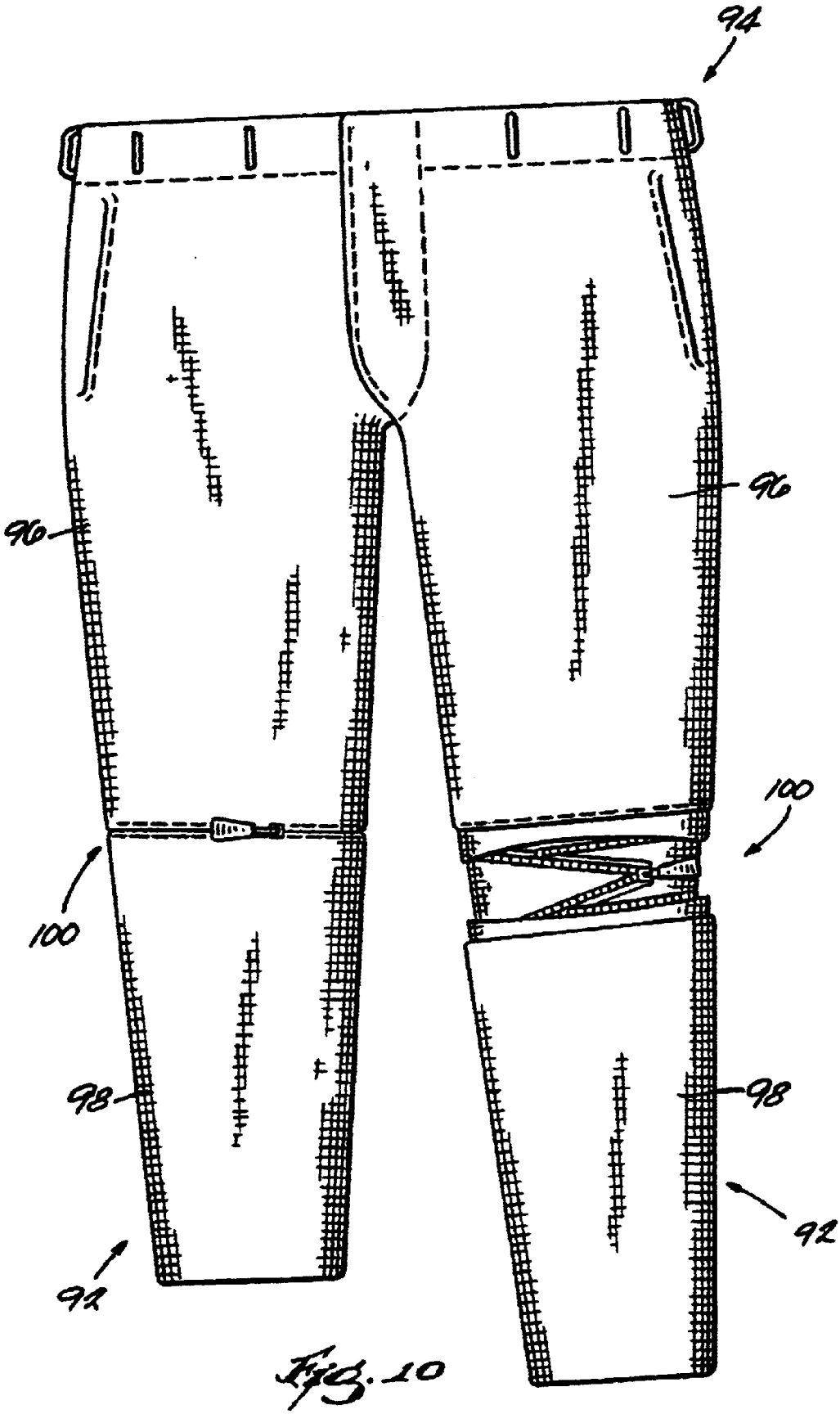
FIG. 10 is a front view of a pair of pants including adjustable pant legs embodying the present invention.

FIG. 10 illustrates the invention embodied in pant legs 92 of a pair of pants 94. It should be apparent to one of ordinary skill in the art that the previous description of the invention embodied in a sleeve 18 is also applicable to the invention embodied in a pant leg 92. Similar to the sleeve 18, the pant legs 92 each include an upper leg portion 96, a lower leg portion 98, and an expandable portion 100 between the upper and lower portions 96, 98. As used herein, "pant leg" refers to the leg covering portions of pants, shorts, chaps, or any other lower extremity garment. It should be appreciated that the structure, components, configuration, and method of length adjustment of the pant legs 92 is substantially the same as that of the previously described jacket sleeve 18.

Various features of the invention are set forth in the following claims.

What is claimed is:

1. An article of clothing comprising:

a body portion adapted to at least partially surround a human torso;

a sleeve including upper and lower sleeve portions, the lower sleeve portion having a cuff edge and a lower edge opposite to the cuff edge the upper sleeve portion having a sleeve edge and an upper edge opposite to the sleeve edge, the sleeve edge coupled to the body portion;

an intermediate portion connected between the lower and upper edges; and a fastener adjustable to connect the lower and upper edges defining a first sleeve length extending between the cuff edge and the sleeve edge, and adjustable to disconnect the lower and upper edges thereby extending;

the sleeve to a second sleeve length, the second sleeve length being longer than the first sleeve length, wherein the intermediate portion is hidden from view when the lower and upper edges are connected and exposed when the lower and upper edges are disconnected.

2. The article of clothing of claim 1, wherein the fastener includes a zipper extending circumferentially around the sleeve.

3. The article of clothing of claim 2, wherein closing the zipper adjusts the sleeve to the first sleeve length, and wherein opening the zipper adjusts the sleeve to the second sleeve length.

4. The article of clothing of claim 1, wherein the upper edge extends circumferentially around the sleeve and the lower edge extends circumferentially around the sleeve.

5. The article of clothing of claim 4, wherein the upper edge includes an upper row of zipper teeth, and the lower edge includes a lower row of zipper teeth, and wherein the upper row and lower row of zipper teeth may be joined to each other to adjust the sleeve to the first sleeve length.

6. The article of clothing of claim 5, wherein at least a portion of the upper row and lower row of zipper teeth are always joined.

7. The article of clothing of claim 4, wherein the fastener includes a zipper having a first zipper stop and a second zipper stop, and wherein the first zipper stop is secured to the intermediate portion intermediate the upper edge and the lower edge, and wherein the second zipper stop is secured to one of the upper edge and lower edge.

8. The article of clothing of claim 7, wherein the zipper includes a zipper pull, and wherein adjusting the sleeve from the second length to the first length comprises moving the zipper pull from the first zipper stop at least completely around the sleeve to the second zipper stop.

9. A method for adjusting a sleeve length on an article of clothing comprising:

providing an article of clothing including a sleeve, an intermediate portion, and a fastener, the sleeve having upper and lower sleeve portions, the lower sleeve portion having a cuff edge and a lower edge opposite to the cuff edge, the upper sleeve portion having a sleeve edge and an upper edge opposite to the sleeve edge, the sleeve edge coupled to a body portion of the article of clothing, the upper edge extending circumferentially around the upper portion and the lower edge extending circumferentially around the lower portion, the intermediate portion connected between the lower and upper edges;

connecting the lower and upper edges with the fastener to define a first length extending between the cuff edge and the sleeve edge;

hiding the intermediate portion from view when the lower and upper edges are connected by the fastener;

disconnecting the lower and upper edges with the fastener thereby extending the sleeve to a second length longer than the first length; and exposing the intermediate portion when the lower and upper edges are not connected by the fastener.

10. The method of claim 9, wherein connecting the lower and upper edges includes coupling an upper row of zipper teeth that is secured to the upper edge to a lower row of zipper teeth that is secured to the lower edge.

11. The method of claim 10, wherein coupling the upper row to the lower row comprises moving a zipper pull from a first zipper stop, at least completely around the sleeve to a second zipper stop.

12. The method of claim 9, wherein disconnecting the lower and upper edges includes decoupling an upper row of zipper teeth that is secured to the upper edge from a lower row of zipper teeth that is secured to the lower edge.

13. An article of clothing comprising:

a portion adapted to at least partially surround a portion of a human body;

a tubular portion including an upper tubular portion coupled to the body portion on a first end and having a first edge extending circumferentially around a second end of the upper tubular portion, an expandable portion having an upper edge adjacent the first edge and a lower edge, the lower edge spaced a distance from the upper edge, and a lower tubular portion having a second edge adjacent the lower edge on a first end, and a cuff opening surrounded by a cuff edge on a second end wherein the lower edge may be directly coupled to the upper edge, thereby adjusting the tubular portion to a first length, and wherein the lower edge may be separated from the upper edge, thereby adjusting the tubular portion to a second length, the second length being longer than the first length, wherein the expandable portion is substantially hidden from view when the lower and upper edges are coupled and exposed when the lower and upper edges are disconnected.

14. The article of clothing of claim 13, wherein the second length comprises the sum of the first length and the distance.

15. The article of clothing of claim 13, further comprising an upper row of zipper teeth extending along the upper edge and a lower row of zipper teeth extending along the lower edge.

16. The article of clothing of claim 15, wherein joining the upper row of zipper teeth and the lower row of zipper teeth to each other adjusts the tubular portion to the first length, and wherein separating the upper row of zipper teeth and the lower row of zipper teeth from each other adjusts the tubular portion to the second length.

17. The article of clothing of claim 13, wherein the expandable portion includes a zipper having a first zipper stop and a second zipper stop, and wherein the first zipper stop is secured to the expandable portion intermediate the upper edge and the lower edge, and wherein the second zipper stop is secured to one of the upper edge and lower edge.

18. The article of clothing of claim 17, wherein the zipper includes a zipper pull, and wherein adjusting the tubular portion from the second length to the first length comprises moving the zipper pull from the first zipper stop at least completely around the tubular portion to the second zipper stop.

19. The article of clothing of claim 13, wherein the article of clothing is a jacket and the tubular portion is a sleeve.

20. The article of clothing of claim 13, wherein the article of clothing is pants and the tubular portion is a pant leg.

21. An article of clothing comprising:

a body portion adapted to at least partially surround a human trunk area;

a limb portion including upper and lower limb portions, the lower limb portion having a cuff edge and a lower edge opposite to the cuff edge, the upper limb portion having an inseam edge and an upper edge opposite to the inseam edge, the inseam edge coupled to the body portion;

an intermediate portion connected between the lower and upper edges; and a fastener adjustable to connect the lower and upper edges defining a first length extending between the cuff edge and the inseam edge, and adjustable to disconnect the lower and upper edges thereby extending the limb portion to a second length, the second length being longer than the first length, wherein the intermediate portion is hidden from view when the lower and upper edges are connected and exposed when the lower and upper edges are disconnected.

22. The article of clothing of claim 21, wherein the fastener includes a zipper extending circumferentially around the limb portion.

23. The article of clothing of claim 22, wherein closing the zipper adjusts the limb portion to the first length, and wherein opening the zipper adjusts the limb portion to the second length.

24. The article of clothing of claim 21, wherein the upper edge extends circumferentially around the limb portion and the lower edge extends circumferentially around the limb portion.

25. The article of clothing of claim 24, wherein the upper edge includes an upper row of zipper teeth, and the lower edge includes a lower row of zipper teeth, and wherein the upper row and lower row of zipper teeth may be joined to each other to adjust the limb portion to the first length.

26. The article of clothing of claim 25, wherein at least a portion of the upper row and lower row of zipper teeth are always joined.

27. The article of clothing of claim 24, wherein the fastener includes a zipper having a first zipper stop and a second zipper stop, and wherein the first zipper stop is secured to the intermediate portion intermediate the upper edge and the lower edge, and wherein the second zipper stop is secured to one of the upper edge and lower edge.

28. The article of clothing of claim 27, wherein the zipper includes a zipper pull, and wherein adjusting the limb portion from the second length to the first length comprises moving the zipper pull from the first zipper stop to the second zipper stop.

29. A method for adjusting a pant leg length on an article of clothing comprising:

providing an article of clothing including a pant leg, an intermediate portion, and a fastener, the pant leg having upper and lower pant leg portions, the lower pant leg portion having a cuff edge and a lower edge opposite to the cuff edge, the upper pant leg portion having a inseam edge and an upper edge opposite to the inseam edge, the inseam edge adjacent to a body portion of the article of clothing, the upper edge extending circumferentially around the upper pant leg portion and the lower edge extending circumferentially around the lower pant leg portion, the intermediate portion connected between the lower and upper edges;

connecting the lower and upper edges with the fastener to define a first length extending between the cuff edge and the inseam edge;

hiding the intermediate portion from view when the lower and upper edges are connected by the fastener;

disconnecting the lower and upper edges with the fastener thereby extending the pant leg to a second length longer than the first length; and exposing the intermediate portion when the lower and upper edges are not connected by the fastener.

30. The method of claim 29, wherein connecting the lower and upper edges includes coupling an upper row of zipper teeth that is secured to the upper edge to a lower row of zipper teeth that is secured to the lower edge.

31. The method of claim 30, wherein coupling the upper row to the lower row comprises moving a zipper pull from a first zipper stop, to a second zipper stop.

32. The method of claim 29, wherein disconnecting the lower and upper edges includes decoupling an upper row of zipper teeth that is secured to the upper edge from a lower row of zipper teeth that is secured to the lower edge.

33. An article of clothing comprising:

a body portion adapted to at least partially surround a human trunk area; and a limb portion coupled to the body portion and defining an inseam edge, the limb portion including a cuff edge spaced from the inseam edge, the limb portion having a first length extending between the cuff edge and the inseam edge; and an expandable portion formed in the limb portion wherein the expandable portion is adjustable to extend the limb portion to a second length, the second length being longer than the first length, wherein the expandable portion includes an upper edge extending circumferentially around the limb portion, a lower edge extending circumferentially around the limb portion, and a fabric portion extending between the upper and lower edges, wherein the upper and lower edges are joinable to adjust the limb portion to the first length, and wherein the upper and lower edges are separable to adjust the limb portion to the second length, wherein the upper edge includes an upper row of zipper teeth, and the lower edge includes a lower row of zipper teeth, and wherein the upper row and lower row of zipper teeth may be joined to each other to adjust the limb portion to the first length, and wherein at least a portion of the upper row and lower row of zipper teeth are always joined.

* * * * *

UNITED STATES PATENT AND TRADEMARK OFFICE

CERTIFICATE OF CORRECTION

PATENT NO. : 6,654,968 B2
DATED : December 2, 2003
INVENTOR(S) : David C. Braun and Sean M. Coyle It is certified that error appears in the above-identified patent and that said Letters Patent is hereby corrected as shown below:

Column 5,
Line 9, insert -- , -- after "cuff edge".

Signed and Sealed this

Fourth Day of May, 2004

JON W. DUDAS
*Acting Director of the United States Patent and Trademark Office*